United States Patent [19]

Armstrong et al.

[11] Patent Number: 4,838,543

[45] Date of Patent: Jun. 13, 1989

[54] LOW IMPACT EXERCISE EQUIPMENT

[75] Inventors: Timothy O. Armstrong, Bellevue, Wash.; John W. Bull, Irvine, Calif.

[73] Assignee: Precor Incorporated, Bothell, Wash.

[21] Appl. No.: 264,269

[22] Filed: Oct. 28, 1988

[51] Int. Cl.[4] ..... A63B 23/04

[52] U.S. Cl. ..... 272/70; 272/130; 272/96

[58] Field of Search ..... 272/69, 70, 71, 72, 272/73, 96, 97, 129, 130, 135

[56] References Cited

U.S. PATENT DOCUMENTS

| | | | |
|---|---|---|---|
| 326,247 | 9/1885 | Root | 272/71 |
| 1,176,365 | 3/1916 | Hartnett | 272/71 |
| 1,521,487 | 12/1924 | Turner | 272/126 |
| 2,079,594 | 5/1937 | Clem | 128/25 R |
| 2,253,996 | 8/1941 | Bechman | 272/70 |
| 2,969,060 | 1/1961 | Swanda et al. | 128/25 R |
| 3,381,958 | 10/1965 | Gulland | 272/73 |
| 3,495,824 | 2/1970 | Cuinier | 272/130 |
| 3,511,500 | 5/1970 | Dunn | 272/130 |
| 3,529,474 | 9/1970 | Olson et al. | 73/379 R |
| 3,582,069 | 6/1971 | Flick et al. | 272/70 |
| 3,587,319 | 6/1971 | Andrews | 73/379 R |
| 3,598,404 | 8/1971 | Bowman | 272/96 |
| 3,628,791 | 12/1971 | Garcia | 272/69 |
| 3,747,924 | 7/1973 | Champoux | 272/70 |
| 3,756,595 | 9/1973 | Hague | 272/70 |
| 3,758,112 | 9/1973 | Crum et al. | 272/130 |
| 3,759,511 | 9/1973 | Zinkin et al. | 272/73 |
| 3,792,860 | 2/1974 | Selnes | 272/70 |
| 3,814,420 | 6/1974 | Encke | 272/135 |
| 3,970,302 | 7/1976 | McFee | 272/130 |
| 3,976,058 | 8/1976 | Tidwell | 128/25 R |
| 4,336,934 | 6/1982 | Hanagan et al. | 272/72 |
| 4,550,908 | 11/1985 | Dixon | 272/130 |
| 4,563,001 | 1/1986 | Terauds | 272/72 |
| 4,600,187 | 7/1986 | Schenker | 272/70 |
| 4,618,139 | 10/1986 | Haaheim | 272/70 |
| 4,650,181 | 3/1987 | Yang | 272/72 |
| 4,659,075 | 4/1987 | Wilkinson | 272/70 |
| 4,681,316 | 7/1987 | DeCloux | 272/130 |
| 4,684,126 | 8/1987 | Dalebout et al. | 272/134 |
| 4,708,338 | 11/1987 | Potts | 272/70 |
| 4,733,858 | 3/1988 | Lan | 262/70 |

FOREIGN PATENT DOCUMENTS

| | | |
|---|---|---|
| 73744 | 3/1983 | European Pat. Off. . |
| 523174 | 4/1931 | Fed. Rep. of Germany . |
| 2243794 | 9/1972 | Fed. Rep. of Germany . |
| 2919494 | 11/1980 | Fed. Rep. of Germany . |
| 197806 | 12/1976 | Netherlands . |
| WO86/02008 | 4/1986 | PCT Int'l Appl. . |
| 593703 | 2/1978 | U.S.S.R. . |
| 2010101 | 6/1979 | United Kingdom . |

*Primary Examiner*—Richard J. Apley
*Assistant Examiner*—J. Welsh
*Attorney, Agent, or Firm*—Christensen, O'Connor, Johnson & Kindness

[57] ABSTRACT

An exercise apparatus having a unique support frame including a base, a first upwardly extending member having a handgrip mounted on its upper end, and a second buttress member extending from the base to a point between the ends of the first member. A pair of foot beams pivotally mounted on one of the upwardly extending members. A rope interconnecting the foot beams and extending over a pully mounted on the support frame above the foot beams, a pair of shock absorbers pivotally connected to the foot beams at one end and connected to the support frame at a point above the foot beams at their other end.

19 Claims, 3 Drawing Sheets

LOW IMPACT EXERCISE EQUIPMENT

BACKGROUND OF THE INVENTION

1. Field of the Invention

This invention relates to exercise equipment, and in particular to low impact exercise equipment of a type designed to simulate climbing or jogging while eliminating shock impacts to the user's joints.

2. Description of the Prior Art

Exercise equipment designed to simulate climbing or jogging has long been known. U.S. Pat. No. 2,079,594 discloses motor powered equipment which reciprocates a user's legs upwardly and downwardly as the user rides upon it. Equipment having relatively complex hydraulics for phasing the movement of steps upon which users climb are shown in U.S. Pats. Nos. 4,681,316, 3,529,474 and 3,758,112. A hand and foot exercising device wherein pedals and grips are interconnected by means of a chain and sprocket arrangement is shown in U.S. Pat. No. 3,381,958.

Equipment upon which a user balances while stepping his feet upwardly and downwardly is shown in both U.S. Pats. Nos. 3,511,500 and 3,747,924. In the latter patent, pulleys mounted below the platforms on which a user stands are employed to cause one pedal to move upwardly while another is pressed downwardly by the user. A four-bar linkage is employed to maintain the foot pedals in a horizontal position.

A spring resistance jogging device is shown in U.S. Pat. No. 3,628,791. In this equipment pedals are depressed alternatively as the user jogs in place. The pedals are returned to their horizontal position by a spring positioned therebeneath as the user transfers his weight from one foot to the other.

A training platform including pivoting foot supports interconnected by ropes to a pivoting arm support is disclosed in U.S. Pat. No. 3,792,860. This patent does not disclose the use of any resistance means to control the movement of the foot pedals which consequently pivot unchecked to crash onto the supporting base as the user shifts his weight from one foot pedal to the other. U.S. Pat. No. 4,600,187 discloses a device for simulating walking up steps wherein the treads are mounted on arms interconnected by a rocker plate which causes one step to move upwardly as the other is moved downwardly. Brake shoes are provided to resist rotation of the rocker plate and consequent movement of the foot pedals.

A device for simulating ice skating is shown in U.S. Pat. No. 3,756,595. In this equipment shock absorbers are provided to resist the rearward movement of the user's feet. The foot supports are not interconnected so that the backward movement of one foot pedal does not cause the other to move forward for the next stroke. An exercise stair device is disclosed in U.S. Pat. No. 3,970,302 which includes a pair of foot pedals interconnected by a rope extending over a pulley so that when one pedal moves down the other moves up and vice versa. The support frame for the equipment includes four vertical supports mounted on a base. Shock absorbers are mounted below the foot pedals and extend thereabove to provide a counterforce to the pivotal movement imparted to the foot pedals by the user.

Recent U.S. Pat. No. 4,659,075 discloses a wide variety of exercise devices, including a climbing device shown in FIGS. 17–19, mounted on a pair of A-shaped frames wherein the steps are interconnected by a cord and pulley arrangement for reciprocal motion. A friction brake is associated with the pulley to control the resistance to movement of the foot pedals along the frame legs. Other variations are shown in FIGS. 20–24, including mounting the steps on the ends of hydraulic cylinders. No indication is given as to how the pistons would be retracted into the hydraulic cylinders after the user depresses the step connected thereto.

Known exercise equipment is either unduly complex in structure or operation or fails to provide a low impact means for exercising all major lower body muscle groups.

BRIEF SUMMARY OF THE INVENTION

An exercise apparatus is disclosed which allows a user to climb or jog thereon without causing impact to his foot, ankle, knee or hip joints. The equipment has a unique, support frame having relatively few pieces which perform multiple functions. The support frame includes a stable base member having a main upwardly extending beam mounted thereon which includes a handgrip mounted at its upper end. A second beam is mounted on the base member and extends upwardly to intersect the main beam between its ends. The second beam acts as a buttress support for the first beam while either or both of the beams, depending on their orientation, support a pair of pivotal foot beams, resistance means in the form of shock absorbers extending from the support frame to the foot beams, and a pulley and rope system extending downwardly to reciprocally interconnect the foot beams. The resulting equipment is sturdy and compact and allows for low impact exercise without the use of complex hydraulics, support structure or motorized assistance.

DETAILED DESCRIPTION OF THE PREFERRED EMBODIMENTS

Figure 2:
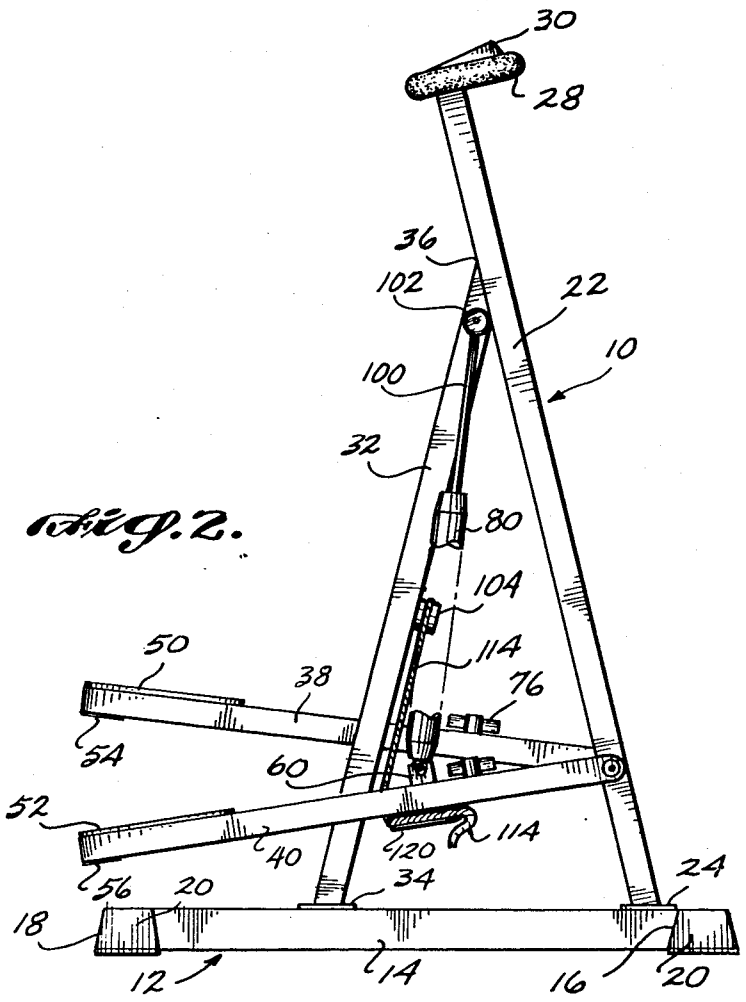
FIG. 2 is a side elevation view of the equipment of FIG. 1.
Figure 1:
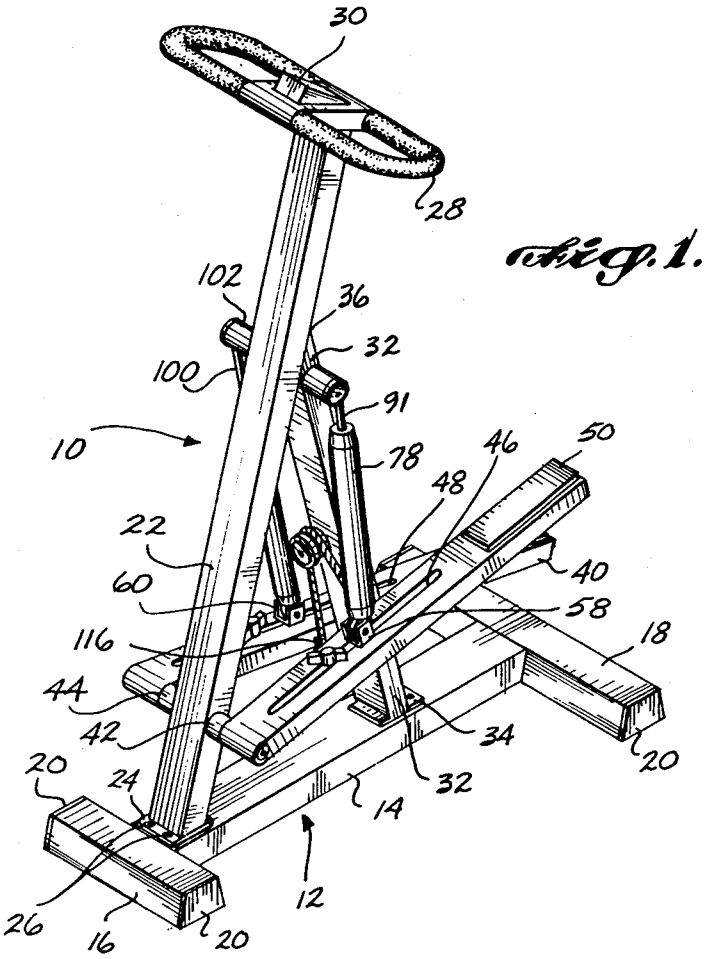
FIG. 1 is a perspective view of the exercise apparatus of the present invention.

Referring initially to FIGS. 1 and 2, a preferred embodiment of the low impact exercise equipment 10 of the present invention is disclosed. As illustrated, the equipment 10 includes a base 12 having a longitudinally extending central beam member 14 with a pair of transverse members 16 and 18 mounted at its opposite ends. It will be understood that the particular shape of the base member is not critical to the present invention, it being required only that the base provide a surface for mounting the upwardly extending members to be described hereafter, as well as providing a sufficiently long and wide footprint to prevent the equipment from tipping during use. An adequate base could be formed from a longitudinal member having but a single lateral member mounted at its rear portion below the user's feet, so long as the lateral member is sufficiently long to prevent the unit from tipping sideways during use. The laterally extending member could extend normal to the longitudinal member or at an angle thereto and could be straight or curved. Other base configurations including a box, a plate or an A-frame having one or more transverse beams extending between diverging longitudinally extending beams could also be used.

In the preferred embodiment the support frame is formed of a steel box beam construction and end plugs or caps 20 are provided to close the ends of the box beams. Beams of other metal or differing configuration could also be satisfactorily used.

As illustrated in FIGS. 1 and 2, a first upwardly extending beam member 22 is shown mounted immediately rearward of forward transverse base beam 16. As illustrated, member 22 includes a foot pad 24 fixed thereto by welding or the like, which includes a pair of openings 25 positioned above cooperating slots or openings in beam 14, in which conventional fasteners are positioned to hold member 22 to longitudinal beam 14. Upwardly extending member 22 may be connected to the beam 14 by any conventional means including welding.

As illustrated, beam 22 extends to a point upwardly and rearwardly from its mounting point on beam 14 and includes a handgrip member 28 at its upper end. Handgrip member 28 includes a pair of laterally extending loops, portions of which are adapted to be gripped by the user during exercise. Alternatively, any conventional handgrip, including a bicycle type handlebar, may be satisfactorily used. An electronic package 30 including a readout screen is shown positioned in the central portion of handgrip 28 where it can be readily viewed by the user of the equipment. Electronic readouts, in general, are known on exercise equipment and such readout is not considered to be a novel portion of the present invention.

Also extending upwardly from longitudinal beam member 14 from a point rearward of the mounting point of the first upwardly extending member 22 is a second structural member 32. Member 32 extends from baseplate 34 to intersect beam member 22 at a point 36 between its upper and lower ends. From a structural point of view, member 32 acts as a buttress to support upwardly extending member 22. As will be discussed hereafter, member 32 also functions in other ways in this equipment, thus reducing the number of elements needed to allow the equipment to operate. It has been found that the disclosed arrangement of a stable base, a first member extending to a point upwardly and rearwardly of its base connection and a buttress member extending to a point upwardly and forwardly from its mounting point on the base beam 14 to interconnect with the main beam between its ends, forms a unique support frame for the presently described equipment which provides not only strength and durability, but also functions in an efficient manner to support the movable elements of the exercise equipment to be described hereafter.

It will be understood that while upwardly extending members 22 and 32 are illustrated in the drawings as straight, beam 22 may be curved rearwardly along its length either immediately from baseplate 24 or from a point along its length after extending a distance vertically upward. Similarly, member 32 may extend vertically upwardly from the base for a distance and then curve forwardly at any desired angle to interconnect with member 22 between its ends. The specific shape of the beams is not critical so long as they accomplish the functions described herein.

The interconnection between members 32 and 22 is preferably made by bolting through a cushioning gasket, but it will be understood that the pieces may be welded together or otherwise fastened together in any conventionally known manner.

Referring again to FIGS. 1 and 2, foot beams 38 and 40 are shown pivotally mounted on support arms 42 and 44 near the lower end of member 22. As shown, foot beams 38 and 40 are formed of a hollow beam construction and include longitudinally extending slots 46 and 48 in their top surface. These slots are adapted to receive means for mounting one end of the resistance means to be described hereafter. The beams also include nonskid foot pads 50 and 52 mounted on their upper surface distal from their pivotal connection to support arms 42 and 44. The foot pads generally locate the area upon which a user stands when exercising with the presently disclosed apparatus. Cushioning pads 54 and 56 are mounted beneath the beams near their ends to cushion contact of the ends of the beams with laterally extending base beam 18 when the foot beams are pivoted downwardly into contact therewith, either during use of the equipment or when a user dismounts.

In the preferred embodiment, support arms 42 and 44 may be formed of a single rod extending through openings in member 22 and supported thereby. Spacers, bearings and fasteners are used to pivotally mount the foot beams on support arms 42 and 44 in a known manner such as will be described hereafter with respect to the mounting of the hydraulic pistons on the equipment.

Figure 3:
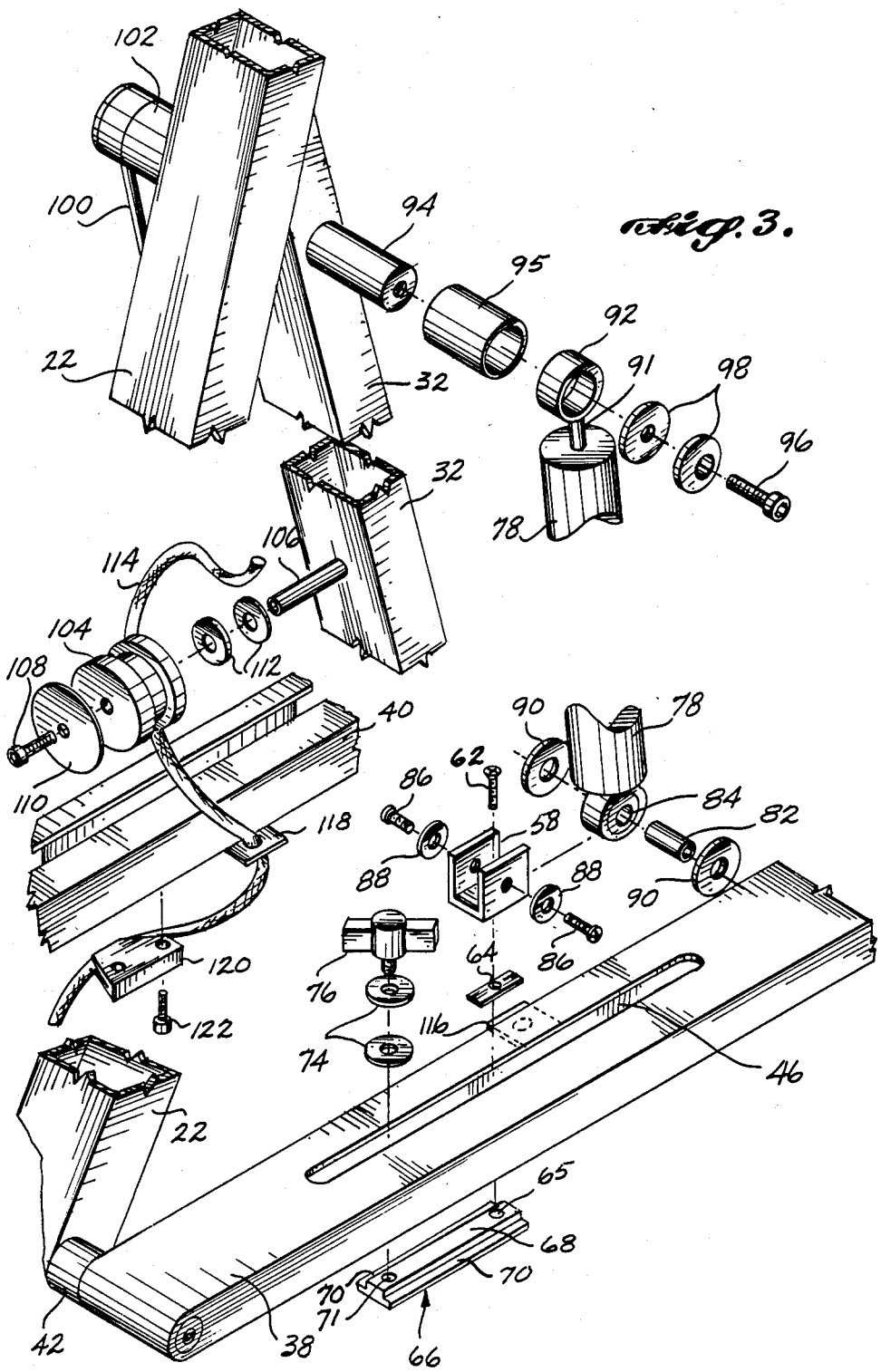
FIG. 3 is a partial perspective view of the support frame of the present invention showing the piston, pulley and rope mounts of the present invention in an exploded view.

Hydraulic piston mounting brackets 58 and 60 are shown slidably mounted in slots 46 and 48 of the foot beams. Referring additionally to FIG. 3, bracket 58 is shown to be channel-shaped and includes an opening in its base portion through which fastener 62 is inserted. Fastener 62 extends through spacer 64 to interconnect with opening 65 in slide plate 66 which is adapted to be positioned within slot 46 of foot beam 38. As shown in FIG. 3, slide plate 66 has a stepped cross section, the uppermost portion 68 being substantially equal in width to the width of slot 46, while shoulders 70 bear against the underside of the upper surface of the foot beam adjacent slot 46.

Slide plate 66 also includes a second opening 71 adapted to receive the threaded lower end of knob 76 that extends through washers 74. It will be understood that the tightening of knob 76 draws slide plate 66 upwardly in slot 46 causing the shoulders 70 to bear against the bottom surface of the top of beam 38 adjacent slot 46. Loosening of knob 76 will allow slide plate 66 to be moved longitudinally along the channel 46. As will be discussed hereafter, movement of the slide plate in the channel allows for modification of the resistance force exerted by resistance means 78 on the pivoting movement of foot beam 38.

As shown in FIGS. 1 and 2, linearly operable resistance means such as shock absorbers 78 and 80 are mounted to extend generally between foot beams 38 and 40 and a mounting point on the support frame thereabove. In FIG. 3, the interconnection of the lower portion of shock absorbers 78 and the hydraulic piston mounting bracket 58 is disclosed to include a longitudinal bearing surface 82, which is adapted to be positioned within the circular opening 84 in the hydraulic piston end mount, and held therein by conventional fasteners 86 and cooperating pairs of washers 88 and 90 positioned on opposite sides of the walls of the hydraulic piston mounting bracket 58. While not illustrated, a similar mounting arrangement is also provided for hydraulic piston 80 to interconnect it with foot beam 40. This mounting arrangement allows the hydraulic pistons 78 and 80 to pivot with respect to mounting brackets 58 and 60 as the foot beams themselves are pivoted around support arms 42 and 44 during operation of the equipment.

Piston arm 91 of the linearly operable resistance means 78 is illustrated in FIG. 3 as including a conventional circular end mounting bracket 92 that is adapted to slip over support arm 94 after cylindrical spacer 95 is positioned thereon. The mounting bracket is held in place by fastener 96 and associated washers 98. An identical arrangement is provided for mounting piston arm 100 of linearly operable resistance means 80 on a support arm 102 positioned on the opposite side of beam 32 from support arm 94. It will be understood that while support arms 94 and 102 are shown mounted on second buttress member 32, they could alternatively be positioned upon first member 22 so long as their point of connection is above foot beams 38 and 40 such that the shock absorbers 78 and 80 are maintained substantially vertical during use.

In operation, it will be understood that the downward movement of a foot beam by a user placing his weight thereon will be resisted by the associated shock absorber, thus requiring the user to do work or exercise in order to overcome the resistance force.

A pulley and cord arrangement is provided to interconnect foot beams 38 and 40 such that when foot beam 38 is depressed, foot beam 40 rises, and vice versa. As shown in FIG. 3, pulley 104 is mounted on a support pin 106 on beam 32, and is adapted to be held thereon by means of threaded fastener 108, which is inserted through washers 110 and 112, and threaded into the end of pin 106. Pin 106, while shown mounted on beam 32, could alternatively be positioned on beam 22 so long as the pulley is mounted above the foot beams such that rope 114 can be maintained in tension during use as will be described hereafter. Rope or cable 114 is fixedly connected to foot beam 38 by being passed through an opening in tab 116, and knotted. Rope 114 extends upward over pulley 104 and downwardly through tab 118 on foot beam 40 where it is then held in place by a conventional jam cleat 120 mounted on the bottom of foot beam 40 by means of conventional fasteners 122.

Figure 4:
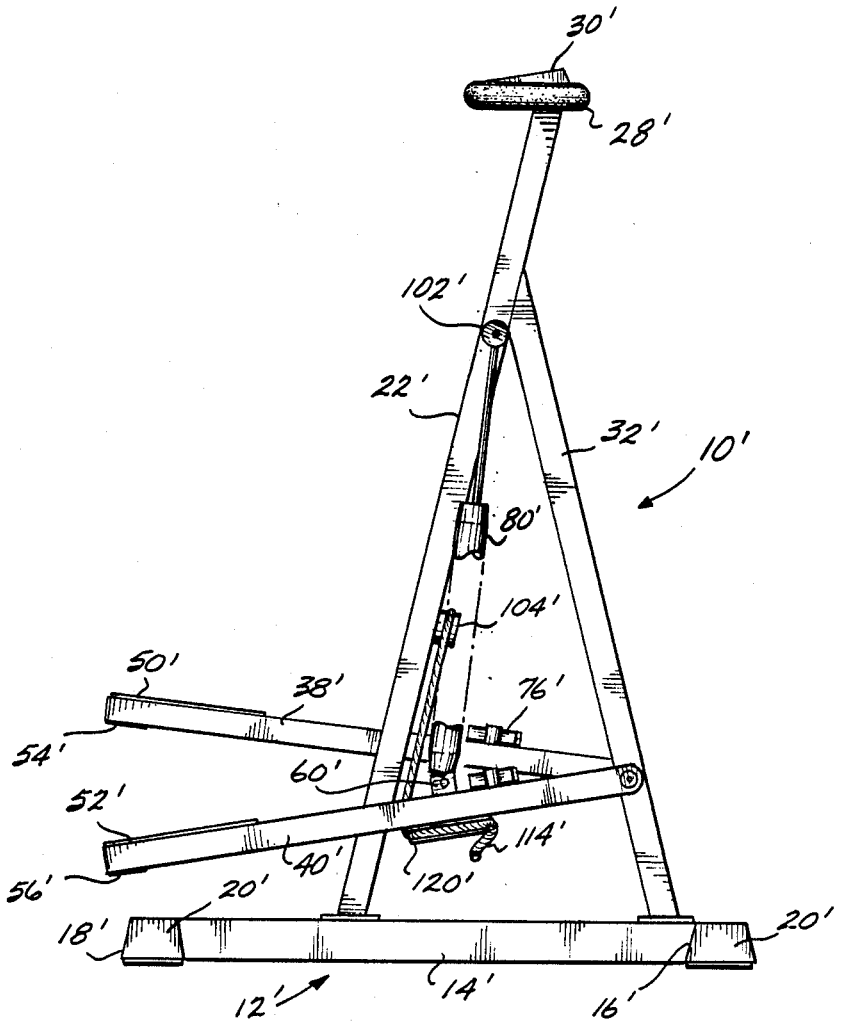
FIG. 4 is a side elevation view of an alternate embodiment of the present invention.

To adjust the stride length, i.e., the distance which foot beams 38 and 40 are spaced from each other at their maximum respective upward and downward movement, rope 114 is released from the jam cleat by pulling the rope from the slack side of the cleat, adjusting the rope to the desired length and replacing the rope in the cleat by pressing it firmly therein. Adjusting the stride length allows for modification of the workload on the user in that it affects the number of strides that a user can take per minute at a given energy output. Another way of modifying the workload on the user is by adjusting the tension in the shock absorbers by loosening knob 76 and sliding slide plate 66 and its associated hydraulic piston mounting bracket within slot 46. The plate is moved backward toward foot pad 50 to increase the force exerted by the shock absorber 78 and thus slow pedal movement. The slide plates in both foot beams 38 and 40 should be positioned at the same distance along the length of the foot beams to assure equal tension on both shock absorbers. Referring additionally to FIG. 4, an alternate embodiment 10' of the present invention is diclosed comprising a first member 22' extending upwardly from longitudinal beam member 14' and a second buttress member 32' extending upwardly from a point on beam member 14' immediately rearward of forward transverse base beam 16' to intersect member 22' between its upper and lower ends.

As illustrated, member 22' includes handgrip member 28' mounted at its upper end. An electronic package 30' is shown positioned in the central portion of handgrip 28'. For purposes of this disclosure, it will be understood that elements of the embodiment illustrated in FIG. 4 which are similar in shape and function to elements of the preferred embodiment of FIGS. 1–3, bear like numbers with the addition of the prime indicator. Thus, for example, base member 12' of FIG. 4 will be understood to be substantially identical to base member 12 of FIGS. 1–3. Obvious differences will be noted in members 22' and 32' to accommodate their differences in orientation and the mounting of foot beams 38' and 40', pulley 104', and shock absorbers 78' and 80' at different locations on said members. It will also be understood that elements not full illustrated in FIG. 4 are similar in shape and function to like elements in FIGS. 1–3.

In FIG. 4, foot beams 38' and 40' are shown to be pivotally mounted on second buttress member 32' near its lower end. These foot beam members extend rearwardly past member 22'. Further, a pair of linearly operable resistance means such as shock absorbers 78' (not illustrated) and 80' are mounted to extend generally between a mounting point on first member 22' above foot beams 38' and 40', and foot beams 38' and 40', respectively. Pulley 104' is also shown mounted on first member 22' above foot beams 38' and 40'.

Although the present invention has been disclosed with respect to several preferred embodiments and modifications thereto, further modifications will be apparent to those skilled in the art. Accordingly, it is not intended that the invention be limited by the disclosure or by such modifications, but instead that its scope should be determined entirely by reference to the claims which follow hereinbelow.

The embodiments of the invention in which an exclusive property or privilege is claimed are defined as follows:

1. An exercise apparatus comprising:

(a) a support frame including a ground engaging base; a first member mounted on said base and extending to a point upwardly and rearwardly from its mounting point on said base; and, a second buttress member, said buttress member being mounted on said base and extending to interconnect with said first member at a point between its ends;

(b) a pair of laterally adjacent foot beams pivotally mounted at one end on said first member at a location above said base member;

(c) pulley means mounted on said support frame above said foot beams;

(d) flexible tie line means attached to each of said foot beams and extending through said pulley means; and, (e) resistance means interconnected between said pivotally mounted foot beams and a location on said support frame above said foot beams and adapted to resist pivotal movement of said foot beams.

2. The exercise apparatus of claim 1 wherein said first member is positioned on said base forward of said second buttress member and said pair of laterally adjacent foot beams extend rearwardly past said buttress member.

3. The exercise apparatus of claim 1 including a pair of support arms extending transversely out from said first member, on opposite sides thereof, one of said foot beams being pivotally mounted on each of said support arms.

4. The exercise apparatus of claim 1 wherein said foot beams are mounted on said first member at a location above said base member such that the pivotal movement of each of said foot beams below said mounting location is substantially equal to the pivotal movement of said foot beam above said location.

5. The exercise apparatus of claim 1 including means for varying the resistance to pivotal movement exerted by said resistance means on said foot beams.

6. The exercise apparatus of claim 1 wherein said resistance means comprises a pair of shock absorbers mounted such that a greater resistance to movement is applied to said foot beams when they are pivoted downwardly than when they are pivoted upwardly.

7. The exercise apparatus of claim 1 wherein said first member extends upwardly and rearwardly from said base and said second buttress member extends upwardly and forwardly from said base to interconnect with said first member.

8. The exercise apparatus of claim 1 wherein said first member includes a handgrip member mounted at its end distal from said base.

9. The exercise apparatus of claim 1 wherein said base member includes at least one longitudinally extending member on which said first member and said second buttress member are mounted and at least one member extending laterally outwardly from said longitudinally extending member.

10. An exercise apparatus comprising:

(a) a support frame including a ground engaging base, a forward member mounted on said base and extending to a point upwardly and rearwardly from its mounting point and a rearward member extending from said base to intersect said forward member at a point between its ends;

(b) a handgrip means mounted on the end of said forward member distal from the base;

(c) a pair of laterally adjacent foot beams pivotally mounted at one end of said forward member, said foot beams extending rearwardly past said rearward member;

(d) pulley means mounted on said support frame above said foot beams;

(e) flexible tie line means connected to each of said foot beams and extending through said pulley means such that when one of said beams is pivoted downwardly the other is forced to pivot upwardly; and, (f) resistance means interconnected between said pivotally mounted foot beams and a location on said support frame above said foot beams, said resistance means adapted to resist pivotal movement of said foot beams.

11. The exercise apparatus of claim 10 including first support arm means extending transversely out from said first member, and foot beams being pivotally mounted on said support arm means.

12. The exercise apparatus of claim 10 including means for varying the resistance force exerted by said resistance means on said foot beams.

13. The exercise apparatus of claim 11 wherein said resistance means comprises a pair of shock absorbers extending between said support frame and said foot beams.

14. The exercise apparatus of claim 13 including second support arm means extending transversely out from support frame parallel to said first support arm means, said shock absorbers each being mounted at their upper ends on said second support arm means and at their lower end of said foot beams.

15. The exercise apparatus of claim 10 wherein said forward member extends upwardly and rearwardly from said base and said rearward member extends upwardly and forwardly from said base to interconnect with said forward member.

16. An exercise apparatus to simulate stair climbing, comprising:

(a) a support frame including a base member, a first member mounted on said base and extending to a point upwardly from the mounting point, and a second buttress member mounted on said base and extending to intersect said first member at a point between its ends;

(b) a pair of laterally adjacent foot beams pivotally mounted at one end on one of said first or second members and extending rearwardly past the other of said members;

(c) pulley means mounted on said support frame above said foot beams;

(d) flexible tie line means connected to each of said foot beams and extending about said pulley means to restrain the foot beams to pivot in opposite directions about their pivotal mounting point; and, (e) linearly operable resistance means connected at one end to one of said first or second members at a location above said foot beams and at its other end to at least one of said foot beams.

17. The exercise apparatus of claim 16 wherein said pulley means is mounted on one of said first or second members at a point above said foot beams.

18. The exercise apparatus of claim 16 wherein said first member extends upwardly and rearwardly from said base member and said second member extends upwardly and forwardly from said base to interconnect with said first member at a point above said foot beams.

19. The exercise apparatus of claim 16 wherein said first member includes a handgrip member mounted at its end distal from said base.

* * * * *

Disclaimer and Dedication 4,838,543.—*Timothy O. Armstrong*, Bellevue, Wash.; *John W. Bull*, Irvine, Calif. LOW IMPACT EXERCISE EQUIPMENT. Patent dated Jun. 13, 1989. Disclaimer and Dedication filed Mar. 23, 1990, by the assignee, Precor Inc.

Hereby disclaims and dedicates to the Public all claims of said patent.

[ *Official Gazette June 26, 1990* ]